United States Patent [19]

von Dreusche, Jr. et al.

[11] 4,118,220

[45] Oct. 3, 1978

[54] METHOD FOR TREATING WASTE MATERIAL

[75] Inventors: Charles F. von Dreusche, Jr., Ramsey; Louis T. Barry, Skillman, both of N.J.

[73] Assignee: Nichols Engineering & Research Corp., Belle Mead, N.J.

[21] Appl. No.: 706,615

[22] Filed: Jul. 19, 1976

[51] Int. Cl.[2] ..... C22B 31/00

[52] U.S. Cl. ..... 75/69; 75/44 S; 75/77; 75/84; 75/101 R; 75/120; 75/121; 75/10 R

[58] Field of Search ..... 75/44 S, 63, 77, 84, 75/69, 10 R, 121, 120, 101 R

[56] References Cited

U.S. PATENT DOCUMENTS

| | | | |
|---|---|---|---|
| 3,632,336 | 1/1972 | Cameron | 75/63 |
| 3,650,830 | 3/1972 | Mathis | 75/445 |
| 3,697,257 | 10/1972 | Perry | 75/77 |

OTHER PUBLICATIONS

Mellor *Inorganic Chemistry,* vol. 11, p. 163, 1931.

*Primary Examiner*—M. J. Andrews
*Attorney, Agent, or Firm*—Edwin T. Grimes

[57] ABSTRACT

Method and apparatus for treating waste material in a counterflow furnace wherein the material is introduced at one end thereof and the processed material is discharged from the other end, while air is simultaneously introduced thereto and the gases of combustion are caused to flow in counter-current direction with respect to the material being processed and are exhausted at the first end of the furnace, and wherein the furnace has a natural tendency to form zones of processing including sequentially from the first end of the furnace, a drying zone, a charring and volatile burning zone, a fixed carbon burning zone and an ash cooling zone, the method comprising the steps of bleeding secondary exhaust gases from the middle of the furnace substantially between the fixed carbon burning zone and the charring and volatile burning zone, and adding air to the furnace in the charring and volatile burning zone. According to one aspect of the invention the secondary exhaust gases are passed in heat exchange relationship with respect to the air being added to the furnace.

4 Claims, 2 Drawing Figures

METHOD FOR TREATING WASTE MATERIAL

BACKGROUND OF THE INVENTION

This invention relates to method and apparatus for treating waste material and more particularly to the treatment of the exhaust gases from incinerating waste material. The invention is particularly adapted, among other possible uses, for use in treating the exhaust gases from incinerating municipal, industrial or community garbage, trash or refuse, and sewage sludge, for example.

The problem of preventing air pollution in our present environment has become a critical matter. The present invention is particularly directed to substantially reducing the particulate matter and other impurities appearing in the exhaust gas from furnaces. The seriousness of this problem is such that the National Air Pollution Control Administration Air Criteria (U.S. Public Health) as well as the Environmental Protection Agency, have constantly been tightening the minimum required standards. In view of the new and higher standards of air emission, it has become more difficult and expensive to remove the solid particles from the furnace exhaust gases. I have substantially reduced this problem in a new and improved manner, as will become apparent as the description proceeds.

SUMMARY OF THE INVENTION

In order to accomplish the desired results, the invention provides, in one form thereof, a new and improved method for treating waste material in a counter-flow furnace wherein the waste material to be processed is introduced at one end thereof and the processed material is discharged from the other, while simultaneously air is introduced thereto and the gases of combustion are caused to flow in counter-current direction with respect to the material being processed and are exhausted at said one end of the furnace. This furnace has a natural tendency to form zones of processing including sequentially from the firt end of the furnace to the other end thereof, a drying zone, a charring and volatile burning zone, a fixed carbon burning zone and an ash cooling zone. Said method comprises the steps of bleeding secondary exhaust gases from the middle of the furnace substantially between the fixed carbon burning zone and the charring and volatile burning zone, and adding air to said furnace in the charring and volatile burning zone. Further, in accordance with one aspect of the invention the secondary exhaust gases are passed in heat exchange relationship with respect to the air being added to the charring and volatile burning zone. According to another aspect of the invention, air is added to the furnace in one of the last named two zones in a quantity below that theoretically required for complete combustion of the material being processed.

The invention, in another form thereof, provides a new and improved apparatus for incinerating waste material characterized by the provision of a multiple hearth furnace having a plurality of vertically spaced hearths, a rotatable center shaft extending through the center of the furnace and passing through each hearth, a plurality of spaced rabble arms secured to the center shaft and extending radially outwardly over each hearth, alternate hearths having drop holes disposed towards the center shaft and the other hearths having drop holes disposed toward the outer periphery thereof. The furnace has an upper material inlet and a lower material dispensing outlet, as well as an upper exhaust gas outlet. This furnace has a natural tendency to form zones of processing including sequentially from the top thereof to the bottom, a drying zone, a charring and volatile burning zone, a fixed carbon burning zone and an ash cooling zone. In addition, means are provided for bleeding secondary exhaust gases from the middle of the furnace substantially between the fixed carbon burning zone and said charring and volatile burning zone, and means are provided for adding air to the furnace in the charring and volatile zone.

The invention in still another form thereof is directed to a new and improved method of treating waste material which includes the steps of continuously introducing the waste material to be processed through an inlet into a primary furnace, while simultaneously adding air to the furnace, heating the waste material in the furnace until it is in a charred state and thence discharging said material from the furnace and passing it to a secondary treatment device, while simultaneously discharging exhaust gas from the furnace. The secondary treatment device in one form thereof comprises means for adding a substantial amount of heat while maintaining a limited supply of oxygen therein so as to recover or remove the heavy metals present in the waste material being processed. In another form of the invention the secondary treatment device comprises means for chemically recovering or removing heavy metals from the waste material. Thereafter, the remainder of the waste material in the secondary treatment device is passed to a secondary furnace to burn the carbonaceous material remaining therein, and thence separately discharging the ash and relatively clean exhaust gas from this secondary furnace.

There has thus been outlined rather broadly the more important features of the invention in order that the detailed description thereof that follows may be better understood, and in order that the present contribution to the art may be better appreciated. There are, of course, additional features of the invention that will be described hereinafter and which will form the subject of the claims appended hereto. Those skilled in the art will appreciate that the conception upon which the disclosure is based may readily be utilized as a basis for the designing of other methods and apparatus for carrying out the several purposes of the invention. It is important, therefore, that the claims be regarded as including such equivalent methods and apparatus as do not depart from the spirit and scope of the invention.

Specific embodiments of the invention have been chosen for purposes of illustration and description, and are shown in the accompanying drawings, forming a part of the specification.

DETAILED DESCRIPTION OF THE PREFERRED EMBODIMENTS

Figure 1:
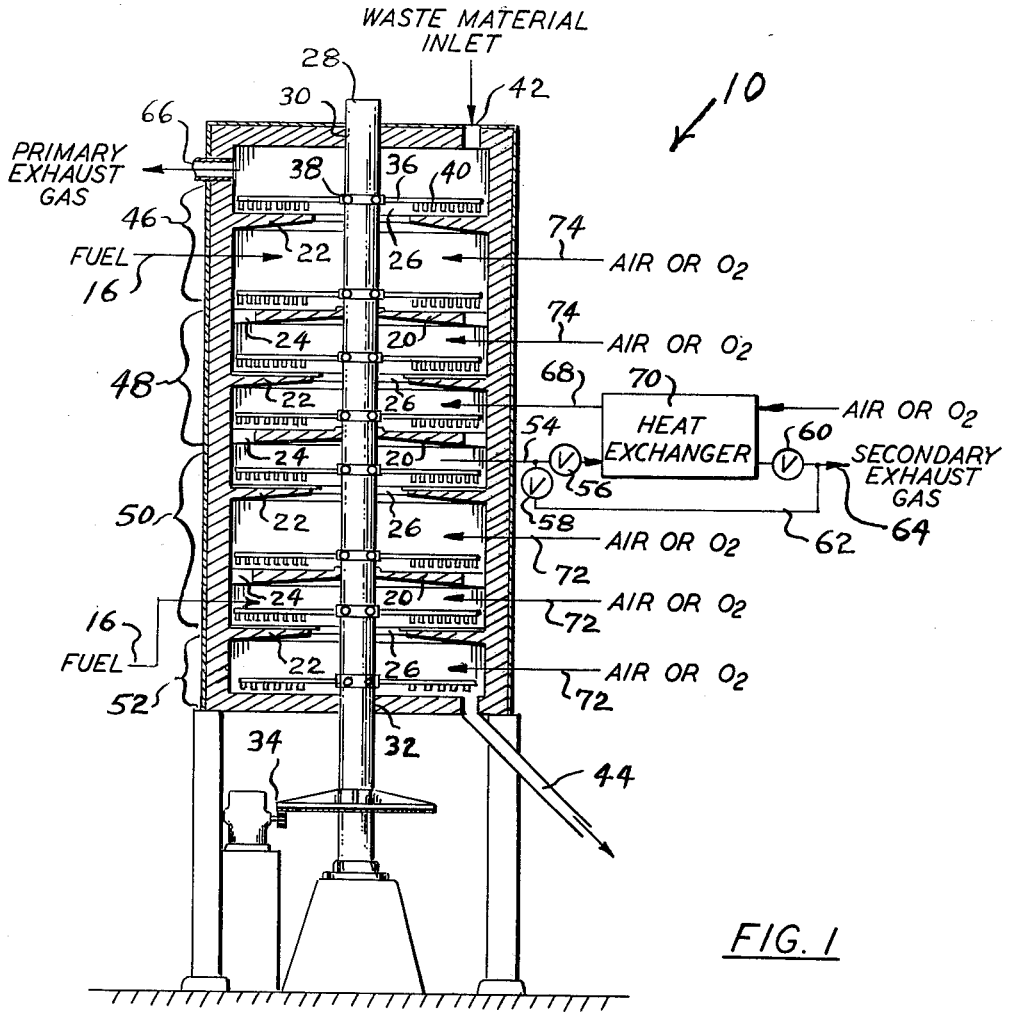
FIG. 1 is a diagrammatic illustration, partially in axial, sectional elevation of a system for incinerating waste material, according to my invention.

In the embodiment of the inventon illustrated in FIG. 1 of the drawings, there is shown a multiple hearth furnace 10 of generally cylindrical configuration. Such a furnace may be of the type, for example, as described in detail in U.S. Pat. No. 3,905,757 issued Sept. 16, 1975.

The furnace is constructed of a tubular outer steel shell 12, which is lined with fire brick or other similar heat resistant material 14. The furnace is provided with a plurality of burner nozzles 16, with one or more being provided on one or more of the hearths, as necessary, for controlling the temperatures within the different regions of the furnace to carry out the particular processing desired. Any suitable type of fuel may be provided to the burners.

The interior of the furnace 10 is divided, by means of hearth floors 20 and 22, into a plurality of vertically aligned hearths, the number of hearths being preselected depending on the particular process being carried out. Each of the hearth floors is made of refractory material and is preferably of slightly arched configuration to be self-supporting within the furnace. Outer peripheral drop holes 24 are provided near the outer shell 12 of the furnace, and central drop holes 26 are formed in alternate hearth floors 22, near the center of the furnace. While FIG. 1 shows the uppermost, or first, hearth as being an in-flow hearth, it will be appreciated that the concepts of my invention apply equally well to a furnace having an out-flow first hearth.

As illustrated in FIG. 1, a rotatable vertical center shaft 28 extends axially through the furnace 10 and is secured by upper bearing means indicated at 30 and lower bearing means 32. This center drive shaft is rotatably driven by an electric motor and gear drive 34, provided for the purpose. A plurality of spaced rabble arms 36 are mounted on the center shaft 28, as at 38, and extend outwardly in each hearth over the hearth floor. The rabble arms have rabble teeth 40 formed thereon which extend downwardly nearly to the hearth floor. The rabble teeth are inclined with respect to the longitudinal axis of their respective rabble arms to that as the rabble arms 36 are carried around by the rotation of the center shaft 28, the rabble teeth 40 continuously rake through the material being processed on the associated hearth floor and gradually urge the material toward the drop holes 24 and 26 in the hearth floors.

The material to be processed enters at the top of the furnace at an inlet 42 and passes downwardly through the furnace in a generally serpentine fashion alternately inwardly and outwardly across the hearths and is discharged at the bottom of the furnace, as indicated at 44.

In effect, the furnace is divided into four zones. However, the zones are not finely segregated, but vary depending on the characteristics of the material being processed. For example, the first or upper zone 46, consisting of the first several hearths, is a drying zone, and the second zone 48 consisting of the next several hearths is a charring or volatile burning zone. The third zone 50 is a fixed carbon burning zone, and the fourth zone 52 is an ash cooling zone.

Heretofore, in order to support combustion, excess air was added at the bottom of the furnace. It will be appreciated that the hottest part of the furnace is in the central portion thereof, i.e. in the lower portion of zone 48 or in the upper portion of zone 50. Problems were encountered due to the fact that these middle hearths tended to overheat beyond the structural design limits of the furnace. In order to overcome this problem, it was thought necessary to add more air or oxygen at the bottom of the furnace. Thus, such a system frequently operated with as much as 100% excess air (above that required for supporting combustion) being added at the bottom of the furnace in order to cool the central portion thereof to workable limits. However, such excess air tended to entrain or carry with it particulate matter into the exhaust gases, which all exited from the top of the furnace.

Further in installations such as the one disclosed in a copending application filed on the same date as the present application and entitled "Method and Apparatus for Incinerating Waste Material", the air supply is controlled so that on most hearths there is a deficiency of oxygen as compared to that theoretically required for complete combustion. However, in the furnace described in said application, all of the exhaust gases exited at the top of the furnace and, hence, there is still the possibility that in some installations some particulate matter could be entrained or carried with the exhaust gases, thereby creating a problem for the downstream scrubbers or other cleaning devices.

According to the present invention, there is provided a secondary exhaust outlet 54 at the middle of the furnace, ie. at about the top of the fixed carbon burning zone 50 or the bottom of the charring or volatile burning zone 48. By manipulation of valves 56, 58 and 60, this exhaust gas may be led via lines 62 and 64 directly to a gas cleaning device, which may be of any suitable conventional type such as a bag collector, hot cyclone, electrostatic precipitator, or mechanical filter, for example. It will be particularly appreciated that this secondary exhaust gas is relatively rich in "heavy metal" particles and/or vapors such as lead, arsenic and antimony just to name a few. Further, the quantity of these secondary exhaust gases is relatively small, as compared to the total quantity of the exhaust gases exiting at the top of the furnace in conventional designs, and hence, it is economical to treat the secondary exhaust gases separately and in a manner particularly suitable to the characteristics thereof. It will be further appreciated that most of this "heavy metal" vapor and/or particulate matter is formed in the lower portion of the furnace, i.e. in the fixed carbon burning zone 50, and hence, according to the invention the upper portions of the furnace will be relatively free of this matter so that the exhaust gases exiting from the furnace at the upper primary exhaust gas outlet 66 may be cleaned or treated in a different manner, that is particularly suitable for its characteristics.

Since the secondary exhaust gases are bled from the furnace in the middle thereof, as indicated at 54 in FIG. 1, additional air or oxygen is added to the furnace at 68 in order to facilitate the processing occuring in the upper zones of the furnace. In some installations, it is desirable to provide a heat exchanger 70 so that by proper manipulation of the valves 56, 58 and 60, the secondary exhaust gases serve to heat the air entering the furnace through the inlet 68. This provides added efficiency to the system.

Further, according to the invention, it has been found desirable to add a minimum quantity of air or oxygen to the furnace at the inlet 72 in the lower portion of the furnace so that there is a minimum quantity of air in the fixed carbon burning zone 50 and then adding relatively larger quantities of air in the charring or volatile burning zone 48 where it is needed, as by the inlet 68 or by the upper air inlets 74.

Figure 2:
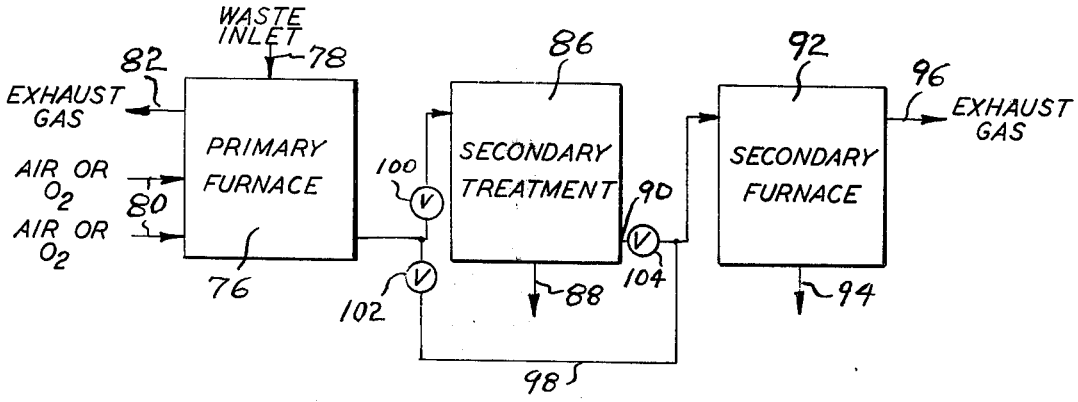
FIG. 2 is a diagrammatic illustration of another embodiment of the invention.

In the embodiment of the invention illustrated in FIG. 2 there is provided a primary furnace 76, of any suitable conventional type, having a waste material inlet 78, air or oxygen inlets 80, an exhaust gas outlet 82 and a processed material outlet 84. The waste material in this furnace is heated so that it is discharged therefrom at 84 in a charred state from which it is passed to a secondary treatment device 86. It is noted that the exhaust gases leaving at the outlet 82 are relatively clean, because substantially little fixed carbon burning has taken place in this furnace. In the secondary treatment device, in one form thereof, heat is added such as by means of an electric arc, and air to a very limited extent may be added, thereby to recover or remove, as indicated at 88, heavy metals which are mixed or compounded in the waste material being processed. Thus, for example, volatile metals such as lead and chromium can be volatilized by an electric arc and then condensed.

In another form, the secondary treatment is effected in a chemical device wherein heavy metals are recovered or removed chemically such as by dissolving the heavy metals in acid and then separating them, for example. Also, as an example, chromium can be partly extracted chemically by means of leaching with caustic soda, usually in the presence of some air.

Thereafter, the remaining material in the secondary treatment device 86 is discharged at 90 and passed to a secondary furnace 92, which may be of any conventional type suitable for the purpose. This remaining material is primarily of a carbonaceous nature and is substantially all consumed in the secondary furnace, so that only a small amount of ash is discharged as at 94, and the exhaust gases are discharged as at 96 in a relatively clean condition. It is noted that in some installations, the secondary treatment device 86 may be bypassed through a line 98, as by means of manipulation of the valves 100, 102 and 104, provided for the purpose.

Having thus described the invention with particular reference to the preferred forms thereof, it will be obvious to those skilled in the art to which the invention pertains, after understanding the invention that various changes and modifications may be made therein without departing from the spirit and scope of the invention, as defined by the claims appended hereto.

What is claimed is:

1. A method of treating waste material containing heavy metals and carbonaceous material comprising the steps of continuously introducing waste material to be processed through a waste material inlet into a primary furnace while simultaneously adding air to said furnace, heating said waste material in said furnace until it is in a charred state and thence discharging said material from the furnace and passing it to a secondary treatment device while simultaneously discharging exhaust gas from said furnace, recovering or removing by chemically leaching said heavy metals from said waste material in said secondary treatment device, thereafter passing the remainder of the waste material in the secondary treatment device to a secondary furnace to burn said carbonaceous material remaining in the waste material and separately discharging ash and exhaust gas from said secondary furnace.

2. A method of treating waste material containing heavy metals and carbonaceous material comprising the steps of continuously introducing waste material to be processed through a waste material inlet into a primary furnace while simultaneously adding air to said furnace, heating said waste material in said furnace until it is in a charred state and thence discharging said material from the furnace and passing it to a secondary treatment device while simultaneously discharging exhaust gas from said furnace, recovering or removing by chemical means said heavy metals from said waste material in said secondary treatment device, said step of chemically recovering or removing said heavy metals including the step of dissolving said heavy metals in acid, thereafter passing the remainder of the waste material in the secondary treatment device to a secondary furnace to burn said carbonaceous material remaining in the waste material and separately discharging ash and exhaust gas from said secondary furnace.

3. A method of treating waste material containing heavy metals and carbonaceous material comprising the steps of continuously introducing waste material to be processed through a waste material inlet into a primary furnace while simultaneously adding air to said furnace, heating said waste material in said furnace until it is in a charred state and thence discharging said material from the furnace and passing it to a secondary treatment device while simultaneously discharging exhaust gas from the furnace, adding a substantial amount of heat to said secondary treatment device while maintaining a limited supply of oxygen therein to volatilize said heavy metals thereby to recover or remove the heavy metals present in the waste material being processed, thereafter passing the remainder of the waste material in the secondary treatment device to a secondary furnace to burn said carbonaceous material remaining in the waste material and discharging ash and clean exhaust gas from said secondary furnace.

4. The method of claim 3 wherein said heavy metals are selected from the group consisting of lead, arsenic, antimony and chromium.

* * * * *